US005628220A

United States Patent [19]

Schäfer

[11] Patent Number: 5,628,220

[45] Date of Patent: May 13, 1997

[54] HIGH-PRESSURE BULGE-FORMING SYSTEM FOR TUBULAR WORKPIECES

[75] Inventor: August W. Schäfer, Drolshagen, Germany

[73] Assignee: Wilhelm Schafer Maschinenbau GmbH & Co., Wilnsdorf, Germany

[21] Appl. No.: 422,588

[22] Filed: Apr. 14, 1995

[30] Foreign Application Priority Data

Apr. 15, 1994 [DE] Germany ..... 44 14 706.6

[51] Int. Cl.[6] ..... B21D 26/02; B21J 13/10

[52] U.S. Cl. ..... 72/61; 72/456; 72/420

[58] Field of Search ..... 72/58, 59, 61, 72/62, 455, 456, 420, 421

[56] References Cited

U.S. PATENT DOCUMENTS

| | | | |
|---|---|---|---|
| 2,252,626 | 8/1941 | Goldbeck . | |
| 3,452,577 | 7/1969 | Schmeltzer et al. . | |
| 5,396,786 | 3/1995 | Bartholomew et al. | 72/88 |
| 5,415,021 | 5/1995 | Folmer | 72/61 |
| 5,481,892 | 1/1996 | Roper et al. | 72/61 |
| 5,499,520 | 3/1996 | Roper | 72/58 |

FOREIGN PATENT DOCUMENTS

| | | | |
|---|---|---|---|
| 1357 | 1/1976 | Japan | 72/58 |
| 199530 | 12/1982 | Japan | 72/61 |

*Primary Examiner*—David Jones
*Attorney, Agent, or Firm*—Herbert Dubno; Andrew Wilford

[57] ABSTRACT

An apparatus for high-pressure bulge forming of tubular workpieces has an upper die plate facing generally downward and extending at an acute angle to the vertical and a lower die plate generally parallel to and confronting the upper die plate. One of the plates is movable along an axis generally perpendicular to the plates toward and away from the other die plate. Respective upper and lower die halves carried on the die plates can fit together to form a die cavity having open ends and are adapted to receive a one of the workpieces with ends of the workpiece exposed at the open ends of the die cavity. The one die plate and the respective die half are displaceable toward and away from the other die plate. Respective actuators on the upper die plate have heads engageable with the ends of the workpiece in the die cavity and one head is formed with a passage for internally pressurizing the workpiece in the die cavity for bulge-deforming the workpiece. A robot takes a workpiece from a supply of the workpieces and fits it to the upper die half. A bin or the like is provided below the upper die half for catching workpieces dropped therefrom.

8 Claims, 2 Drawing Sheets

HIGH-PRESSURE BULGE-FORMING SYSTEM FOR TUBULAR WORKPIECES

FIELD OF THE INVENTION

The present invention relates to a high-pressure bulge-forming system. More particularly this invention concerns such a system used to shape tubular workpieces, for instance to make pipe fittings.

BACKGROUND OF THE INVENTION

As described in my copending application Ser. No. 08/255,778 filed 8 June 1994 (now U.S. Pat. No. 5,435,163 issued 24 July 1995) it is known to bulge-form a tubular workpiece by means of an apparatus that has a stationary base, a die fixed on the base and formed with a cavity having an inner surface and axially oppositely open ends so that a tubular workpiece can be held in the cavity with ends of the workpiece exposed at the ends of the cavity, and a pair of pistons fittable with the workpiece ends. Respective actuators can displace the pistons toward each other and against the ends of the workpiece in the cavity. A hydraulic liquid is fed at high pressure through one of the pistons to an interior of the workpiece in the cavity to deform the workpiece. Respective first guides support the pistons on the base for vertical movement thereon, respective second guides support the pistons on the base for horizontal movement thereon, and respective third guides support the pistons on the base for pivotal movement about respective centers.

With such an arrangement (See also *Werkstatt und Betrieb* 122 [1989]9 p. 767.) it is standard for the actuators and a lower die half to be mounted on a horizontal plate, with the upper die half being pushed down onto the lower half to form the die cavity around the tubular workpiece, whereupon the actuators advance the pistons to allow the workpiece interior to be pressurized. The pressure is so great, often in excess of 1000 kp/mm$^2$, that the tubular workpiece is bulged outward to conform to the interior of the die, producing a finished product that is cold-formed to high tolerances.

In an automated production line a robot is used to load and unload the die. Thus once the workpiece is fully formed the upper die half is raised and the two pistons are retracted so that the robot can pick out the finished part. Then the robot fetches another workpiece and places it in the lower die cavity, whereupon the cycle can be repeated. Such a procedure is relatively time consuming.

Even though in some systems (See U.S. Pat. Nos. 2,252,626 and 3,452,577.) it is known to orient the press parts to somewhat facilitate loading and unloading operations, these known systems remain fairly clumsy and inefficient. They are not readily adaptable to a high-pressure bulge-forming press.

OBJECTS OF THE INVENTION

It is therefore an object of the present invention to provide an improved high-pressure bulge-forming system for tubular workpieces.

Another object is the provision of such an improved high-pressure bulge-forming system for tubular workpieces which overcomes the above-given disadvantages, that is which can cycle more rapidly than the prior-art systems.

A further object is to provide an improved method of operating the apparatus.

SUMMARY OF THE INVENTION

An apparatus for high-pressure bulge forming of tubular workpieces has according to the invention an upper die plate facing generally downward and extending at an acute angle to the vertical and a lower die plate generally parallel to and confronting the upper die plate. One of the plates is movable along an axis generally perpendicular to the plates toward and away from the other die plate. Respective upper and lower die halves carried on the die plates can fit together to form a die cavity having open ends and are adapted to receive a one of the workpieces with ends of the workpiece exposed at the open ends of the die cavity. The one die plate and the respective die half are displaceable toward and away from the other die plate. Respective actuators on the upper die plate have heads engageable with the ends of the workpiece in the die cavity and one head is formed with a passage for internally pressurizing the workpiece in the die cavity for bulge-deforming the workpiece. A robot takes a workpiece from a supply of the workpieces and fits it to the upper die half. A bin or the like is provided below the upper die half for catching workpieces dropped therefrom.

The apparatus has a controller connected to the actuators, pressurizer, and robot for carrying out the method of this invention, with the die plates and halves being moved apart into an open position and then a workpiece from the supply is fitted to the upper die half with the robot. The heads being advanced into engagement with the workpiece to secure it in the upper die half and the die plates and halves are moved together into a closed position. Then the workpiece is internally pressurized to bulge form it to the die cavity whereupon it is depressurized. The die plates and halves are displaced apart and the heads are pulled back from engagement with the workpiece to drop the workpiece from the upper die half. Then these steps are repeated with another workpiece from the supply.

Thus with this system the workpiece drops out of the upper die half so no equipment need be used to pick it out of the die. The supply robot can serve merely to fit fresh workpieces to the upper die half, so it can cycle twice as rapidly. This substantially cuts the time needed to unload and reload the machine and therefore increases production efficiency.

According to the invention the actuator heads are horizontally displaceable and horizontally flank the upper die half. In addition the upper plate and die half are fixed so that the one movable plate is the lower plate. The angle of the downwardly facing upper plate to the vertical is between 30° and 45°. It is possible in accordance with the invention to equip the upper die plate with a punch-type demolding device to knock the formed workpiece out of the upper die half.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
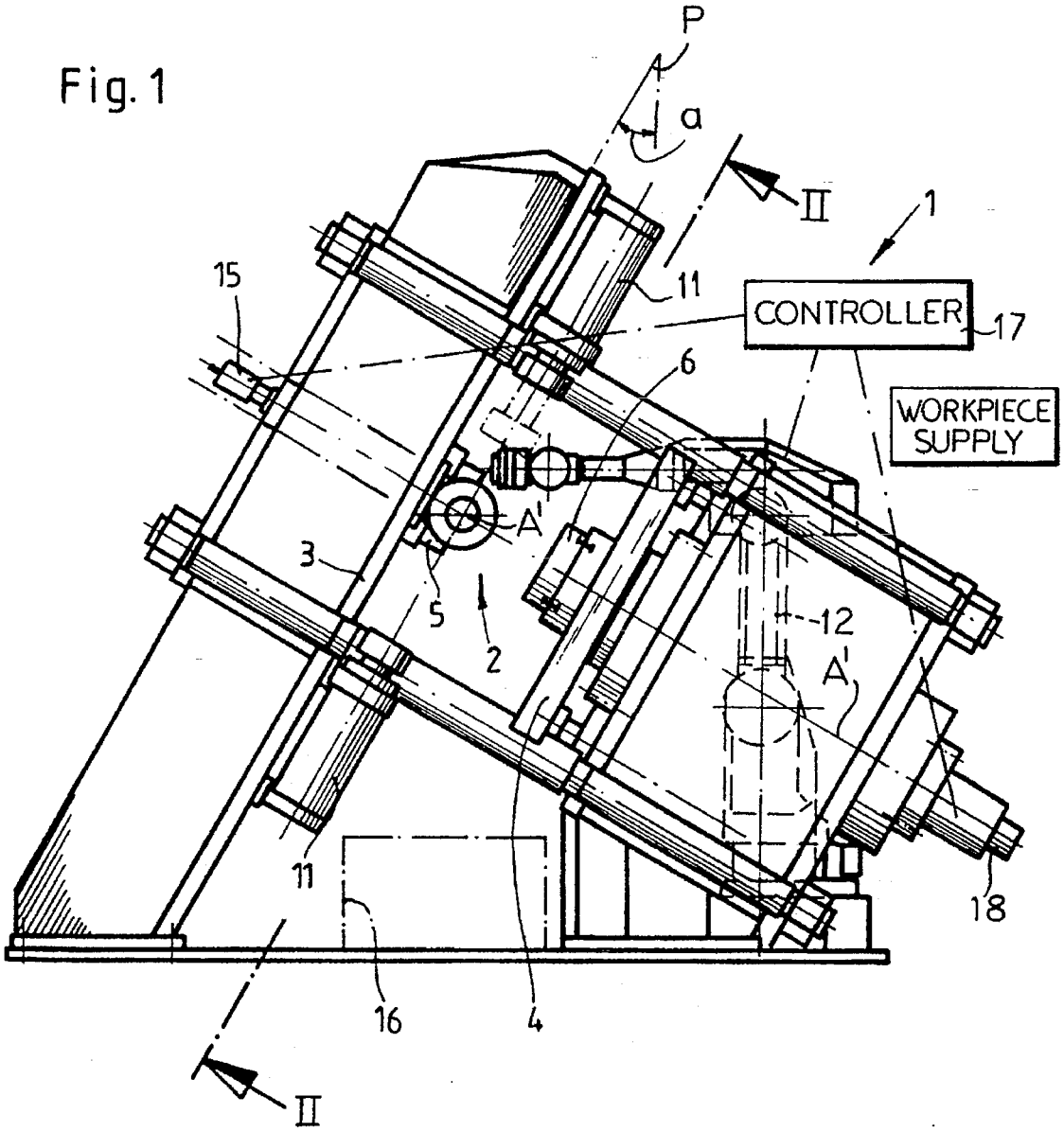
FIG. 1 is a small-scale side view of the apparatus according to the invention.
Figure 2:
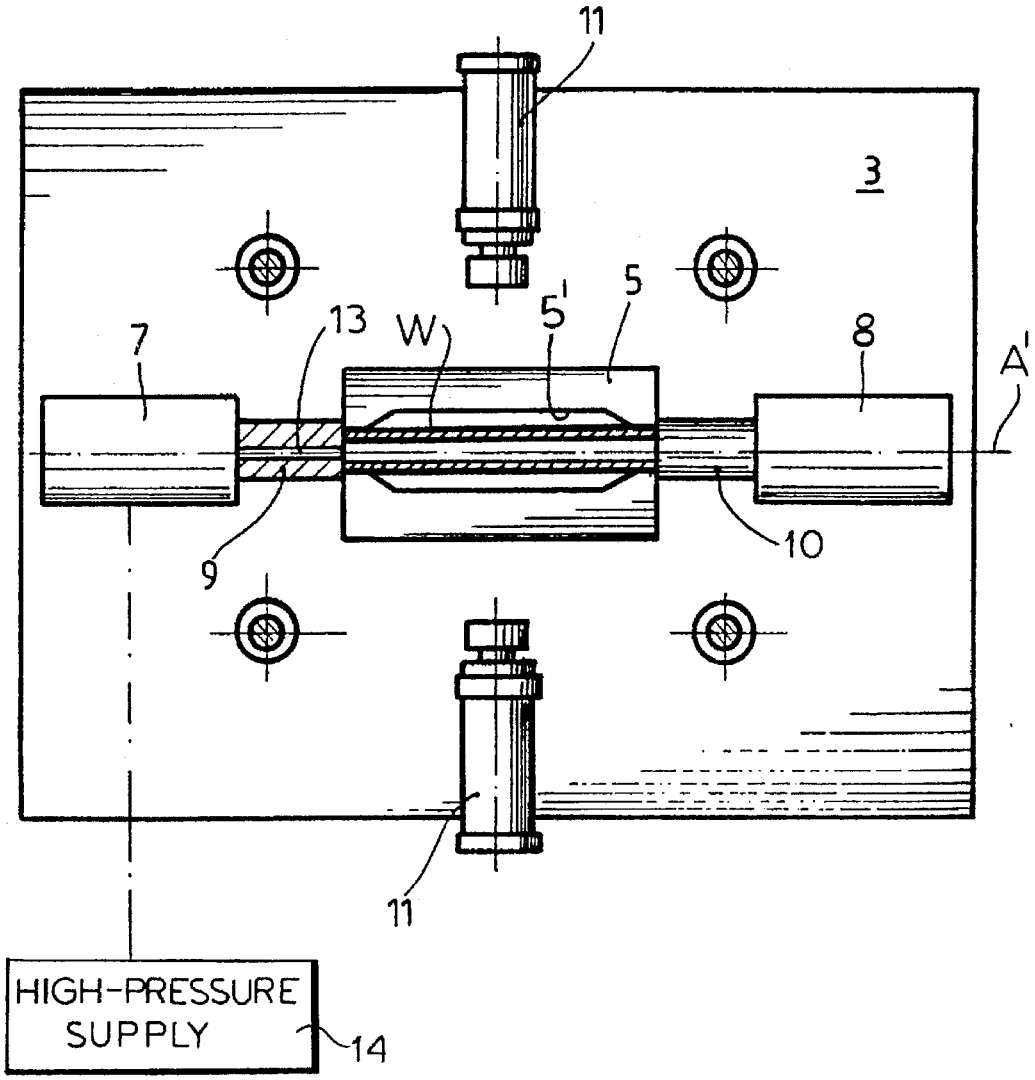
FIG. 2 is a partly schematic and partly diagrammatic section taken along line II—II of FIG. 1.

As seen in FIGS. 1 and 2 a shaping press according to this invention has a die 2 constituted by an upper die half 5 fixed to a stationary press plate 3 and a lower die half 6 carried on a movable press plate 4 displaced by a ram 18 along an axis A toward and away from the fixed plate 3. A pair of actuators 7 and 8 carried on the plate 3 have piston heads 9 and 10 engageable along a horizontal axis A' perpendicular to the axis A with ends of a workpiece W that is seated in an open-ended cavity 5' of the fixed upper die half 5. The piston 9 of the actuator 7 is formed with a passage 13 connected to a high-pressure source or supply 14 that can internally pressurize the workpiece W sufficiently to deform it. Further actuators 11 are provided on the plate 3 vertically flanking the fixed die half 5 and effective perpendicular to the axis A' for use when a different fitting, for instance a tee or crossover, is being made.

A robot 12 to one side of the press 1 can pick tubular workpieces W out of a supply 19 and fit them to the cavity 5' of the fixed die half 5. Once fitted to the die half 5 the two actuators 7 and 8 advance the rams or pistons 9 and 10 to hold the workpiece W in place, whereupon the actuator 18 advances the press plate 4 and other die half 6 along the axis A to close the die 2. Then pressure is applied through the passage 13 to outwardly bulge the workpiece W so its outer surface corresponds to the inner surface of the cavity of the die 2.

According to the invention the plate 3 lies in a plane P inclined at an acute angle a of 30° to a vertical line or plane V so that it and the parallel upper face of the die half 5 face generally downward and the cavity 5' of the die half 5 opens generally downward also. A workpiece catch bin 16 is provided underneath the die half 5 and a punch-type or pneumatic knockout device 15 is provided on the back side of the plate 3. A microprocessor-type controller 17 is connected to the actuators 7, 8 and 18, to the robot 12, and to the knockout device 15 for synchronously operating these subsystems of the machine.

Thus once the workpiece W has been successfully deformed, the die 2 has been opened, and the piston heads 9 and 10 have been retracted, the knockout device 15 can push the workpiece W out of the die half 5 to fall into the bin 16, although in most systems the finished workpiece W will just fall or pop out of the cavity 5' when released. This happens as soon as the two die halves 5 and 6 have been separated enough to allow the workpiece W to fall out, that is almost immediately after the die 2 is opened. Almost immediately the robot 12, which has already picked a fresh workpiece W out of the supply 19, can insert this fresh workpiece W into the die cavity 5'. The rams 9 and 10 then grip the fresh workpiece W so the robot 12 can release it and get out of the way, whereupon the actuator 18 again advances the die half 6 to close the die 2 and repeat the process.

The cycle of the press 1 is therefore quite rapid as the robot 12 serves merely to load workpieces, not load and unload them. Thus the turnover time between presses can be shortened considerably with this system.

I claim:

1. An apparatus for high-pressure bulge forming of tubular workpieces, the apparatus comprising:

an upper die plate facing generally downward and extending at an acute angle to a vertical plane;

a lower die plate generally parallel to and confronting the upper die plate, one of the plates being movable along an axis generally perpendicular to the plates toward and away from the other die plate;

respective upper and lower die halves carried on the die plates and matable together to form a die cavity having open ends and adapted to receive a one of the workpieces with ends of the workpiece exposed at the open ends of the die cavity, the upper die half opening downward;

means for displacing the one die plate and the respective die half toward and away from the other die plate;

respective actuators on the upper die plate having heads engageable with the ends of the workpiece in the die cavity;

pressurizing means including a passage extending through one of the actuator heads for internally pressurizing the workpiece in the die cavity for bulge-deforming the workpiece;

a supply of the tubular workpieces;

means including a robot for fitting a workpiece from the supply and fitting it to the upper die half; and means below the upper die half for catching workpieces dropped therefrom.

2. The bulge-forming apparatus defined in claim 1, further comprising:

control means connected to the actuators, pressurizing means, and robot for synchronously a) displacing the die plates and halves apart into an open position, b) fitting a workpiece from the supply to one of the die halves with the robot, c) displacing the die plates and halves together into a closed position, d) internally pressurizing the workpiece to bulge form it to the die cavity, e) depressurizing the workpiece and displacing the die plates and halves apart, f) retracting the heads from engagement with the workpiece and dropping the workpiece from the upper die half, and g) repeating steps b) through g) with another workpiece.

3. The bulge-forming apparatus defined in claim 1 wherein the actuator heads are horizontally displaceable and horizontally flank the upper die half.

4. The bulge-forming apparatus defined in claim 1 wherein the upper plate and die half are fixed, the one movable plate being the lower plate.

5. The bulge-forming apparatus defined in claim 1 wherein the angle is between 30° and 45°.

6. The bulge-forming apparatus defined in claim 1 wherein the means for catching includes a bin underneath the upper die half.

7. A method of operating an apparatus for high-pressure bulge forming of tubular workpieces, the apparatus comprising:

an upper die plate facing generally downward and extending at an acute angle to a vertical plane;

a lower die plate generally parallel to and confronting the upper die plate, one of the plates being movable along an axis generally perpendicular to the plates toward and away from the other die plate;

respective upper and lower die halves carried on the die plates and matable together to form a die cavity having open ends and adapted to receive a one of the workpieces with ends of the workpiece exposed at the open ends of the die cavity, the upper die half opening downward;

means for displacing the one die plate and the respective die half toward and away from the other die plate;

respective actuators on the upper die plate having heads engageable with the ends of the workpiece in the die cavity;

pressurizing means including a passage extending through one of the actuator heads for internally pressurizing the workpiece in the die cavity for bulge-deforming the workpiece;

a supply of the tubular workpieces;

means including a robot for fitting a workpiece from the supply and fitting it to the upper die half; and means below the upper die half for catching workpieces dropped therefrom; the method comprising the steps of:

a) displacing the die plates and halves apart into an open position, b) fitting a workpiece from the supply to one of the die halves with the robot, c) displacing the die plates and halves together into a closed position, f) internally pressurizing the workpiece to bulge form it to the die cavity, e) depressurizing the workpiece and displacing the die plates and halves apart, f) retracting the heads from engagement with the workpiece and dropping the workpiece from the upper die half, and g) repeating steps b) through f) with another workpiece.

8. The bulge-forming method defined in claim 7, further comprising after step f) and before step g) the step of:

f') knocking the formed workpiece out of the upper die half.

* * * * *